US007373718B2

(12) United States Patent
Lin

(10) Patent No.: US 7,373,718 B2
(45) Date of Patent: May 20, 2008

(54) TEST DEVICE FOR A HEAT DISSIPATING FAN

(75) Inventor: Chun-Pin Lin, Taipei (TW)

(73) Assignee: Asia Vital Components Co., Ltd., Kaohsiung (TW)

( * ) Notice: Subject to any disclaimer, the term of this patent is extended or adjusted under 35 U.S.C. 154(b) by 318 days.

(21) Appl. No.: 11/326,362

(22) Filed: Jan. 6, 2006

(65) Prior Publication Data

US 2007/0159793 A1 Jul. 12, 2007

(51) Int. Cl.
*B23P 19/00* (2006.01)
*H05K 7/20* (2006.01)
*B25B 11/00* (2006.01)

(52) U.S. Cl. ..... 29/743; 29/559; 29/739; 29/740; 29/742; 361/695; 269/21

(58) Field of Classification Search ..... 29/743, 29/742, 740, 759, 786, 779, 783, 559; 361/685, 361/695, 696, 697, 690; 439/487; 324/302, 324/405; 454/184; 165/80.3; 417/423.5
See application file for complete search history.

(56) References Cited

U.S. PATENT DOCUMENTS 5,486,980 A * 1/1996 Jordan et al. ..... 361/697
5,828,550 A * 10/1998 Horng ..... 361/697
6,050,785 A * 4/2000 Horng ..... 417/354
6,074,296 A * 6/2000 Wu ..... 454/184
6,311,766 B1 * 11/2001 Lin et al. ..... 165/80.3

* cited by examiner

*Primary Examiner*—A. Dexter Tugbang
*Assistant Examiner*—Tai Van Nguyen

(57) ABSTRACT

A test device for a heat dissipating fan, which is suitable for testing if the fan wheel is secured to the housing firmly, includes a support post, a transverse slide unit, which is disposed at the top of the support post and provides a transverse slide seat, a vertical slide unit, which is disposed at the transverse slide seat and provides a vertical slide seat. Further, the test device provides a clamping unit, a suction unit and a sensing element, which are moved with the vertical slide seat. The clamping unit clamps the housing and the suction unit absorbs the fan wheel. The heat dissipating fan is admitted in case of the sensing unit sensing the fan wheel being incapable of moving upward under the suction force and is carried away by the transverse slide unit in case of the sensing unit sensing the fan wheel being capable of moving upward under the suction force.

8 Claims, 7 Drawing Sheets

TEST DEVICE FOR A HEAT DISSIPATING FAN

BACKGROUND OF THE INVENTION

1. Field of the Invention

The present invention is related to a test device and particularly to a test device for a heat dissipating fan for testing if the fan wheel is joined to the housing of the fan firmly.

2. Brief Description of the Related Art

Referring to FIG. 1, the conventional heat dissipating fan 1 includes a housing 11 with a support pipe 111, a fan wheel 12, a retaining ring 13, which is disposed in the support pipe 111. The fan wheel 12 has a hub 121 and a shaft 122 mounted to the hub 121, the shaft 122 has an engaging groove 123 at an end thereof. Process for assembling the fan 1 is performed based on the following steps. First, the retaining ring 13 is placed in the support pipe 111. Then, the shaft 122 is inserted into the support pipe 111 through the retaining ring 13. Next, the fan wheel 12 is applied a force to urge the retaining ring 13 for the retaining ring 13 being able to engage with the engaging groove 123 finally.

Too large the preceding force being applied is easy to result in damaging other components beside the retaining ring 13 and too little the preceding force being applied is easy to result in the shaft 122 being incapable of engaging with the retaining ring 13 firmly. Further, some other types heat dissipating fans 1 have another end of the support pipe 111 being a blind end and it makes test with sight impossible. Hence, in order to make sure the fan wheel 12 being secured to the housing 11 firmly, several inspectors have to be assigned to pull the fan wheel 12 beside the assembling line. When the fan wheels 12 move with the pull force exerted by the inspectors, it hints that the engaging groove 123 does not engage with the retaining ring 13 completely.

As the foregoing, for securing quality of assembled heat dissipating fans 1, inspectors have to be hired to check every fan 1 and it not only incurs more production cost but also is unable to promote production efficiency. In addition, manual check often occurs careless mistakes because the pull forces applied by the inspectors are hard to keep in a constant direction.

SUMMARY OF THE INVENTION

In order to solve the preceding problems, an object of the present invention is to provide a test device for a heat dissipating fan with which assembling quality of the heat dissipating fan can be secured and the production cost can be lowed with promotion of production efficiency.

Accordingly, the test device for a heat dissipating fan according to the present invention, which is suitable for testing if the fan wheel is secured to the housing firmly, includes a support post, a transverse slide unit, which is disposed at the top of the support post and provides a transverse slide seat, a vertical slide unit, which is disposed at the transverse slide seat and provides a vertical slide seat. The transverse unit provides a transverse slide actuating piece and a transverse slide seat, which is actuated by the vertical slide actuating piece. The vertical slide unit provides a vertical slide actuating piece at the transverse slide seat and a vertical slide seat, which is actuated by the vertical slide actuating piece. The clamping unit moves with the vertical slide seat for clamping the housing. The suction unit moves with the vertical slide seat for absorbing the fan wheel. The sensing element moves with the vertical slide seat and is disposed near the suction unit for sensing if the suction unit is able to absorb and move the fan wheel upward.

The suction unit having a force moving upward is capable of reaching consistence of testing so as to determine precisely if the fan wheel is assembled to the housing firmly. In addition, it is not necessary to dispatch inspector personnel for saving production cost and it is capable of promoting efficiency of production by means of the test device with automatic testing process.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE INVENTION

Figure 1:
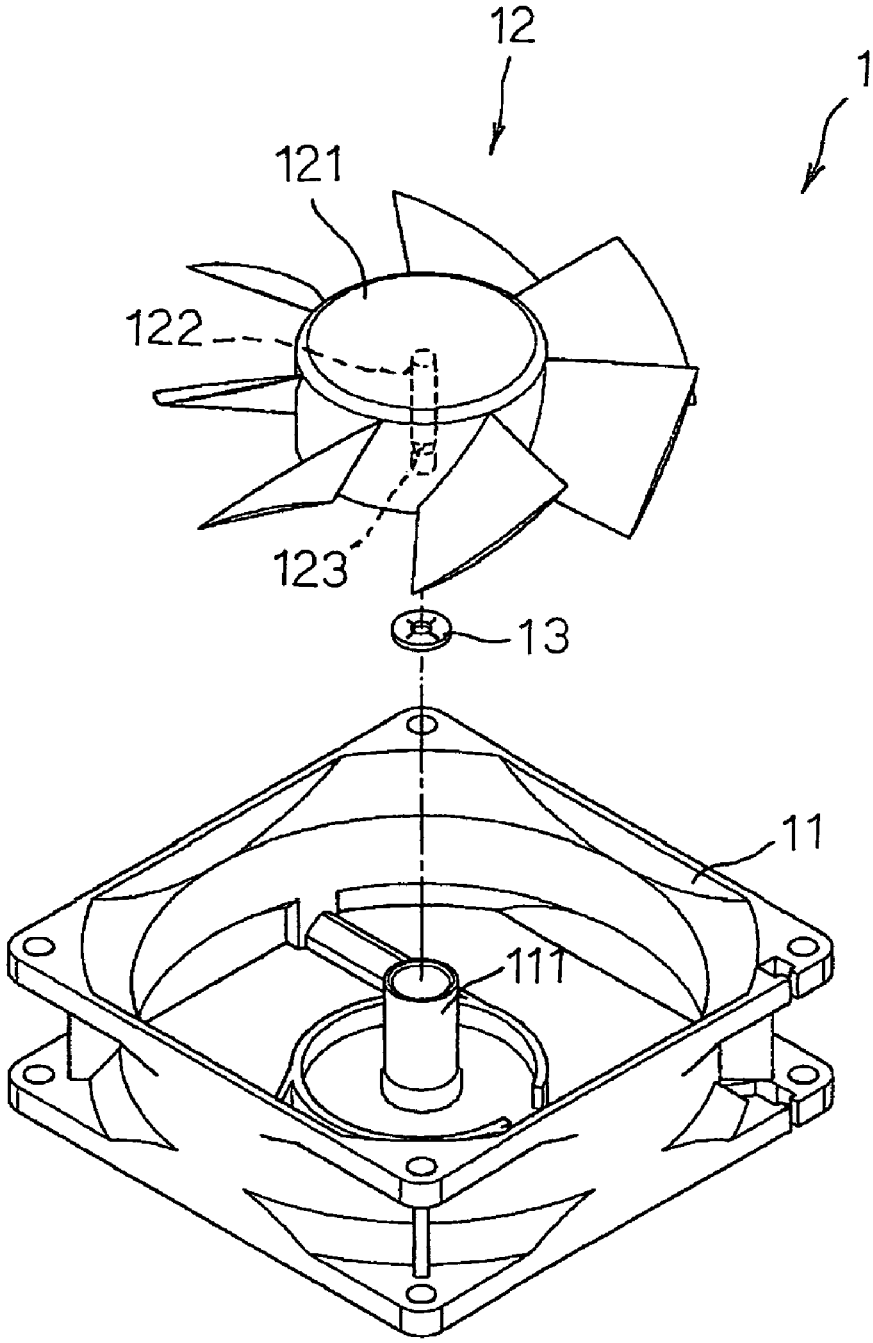
FIG. 1 is an exploded perspective view of a heat dissipating fan.
Figure 2:
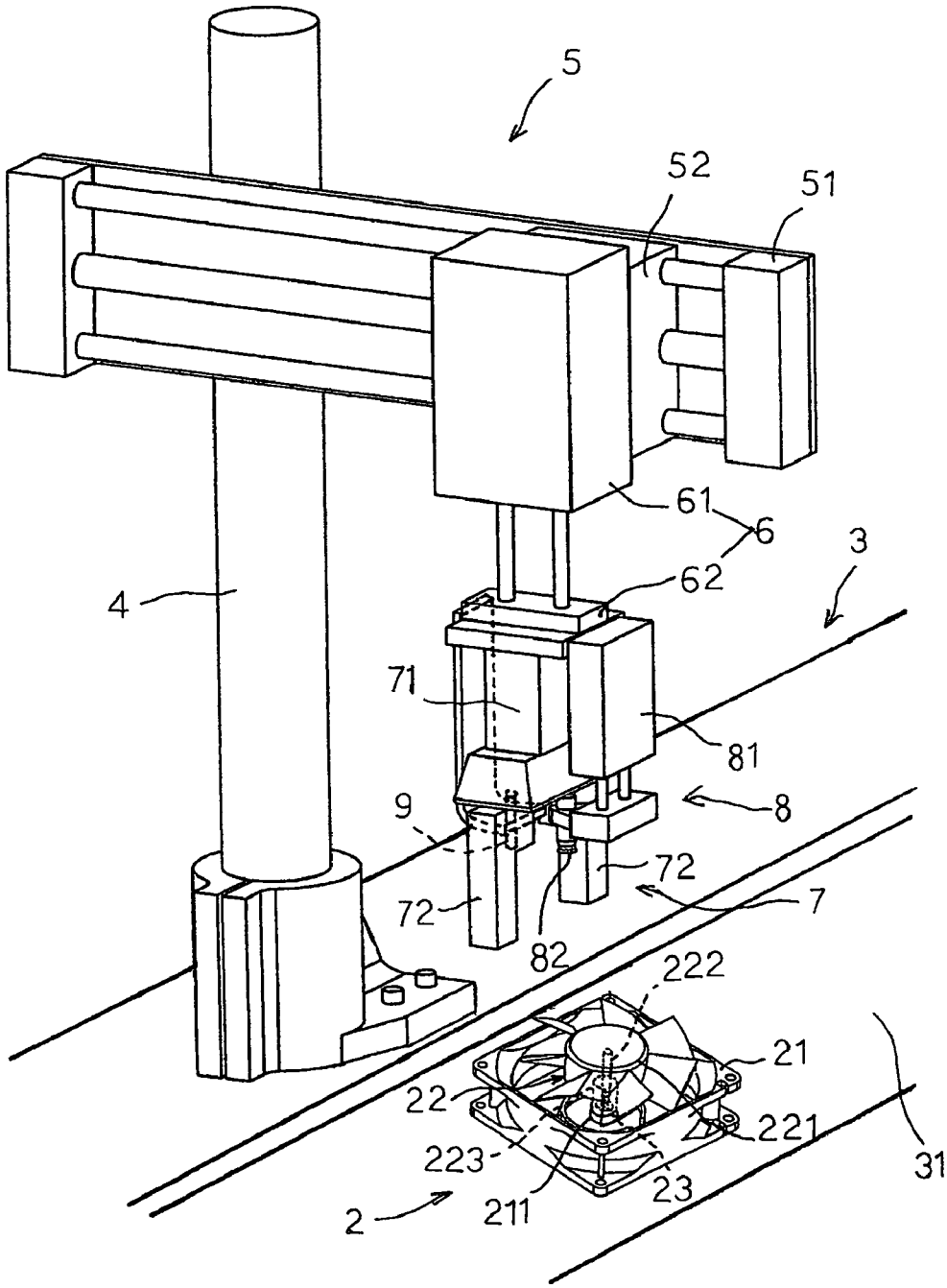
FIG. 2 is a perspective view of a preferred embodiment of a test device according to the present invention for testing if the fan wheel is joined to the housing of a heat dissipation fan firmly.
Figure 3:
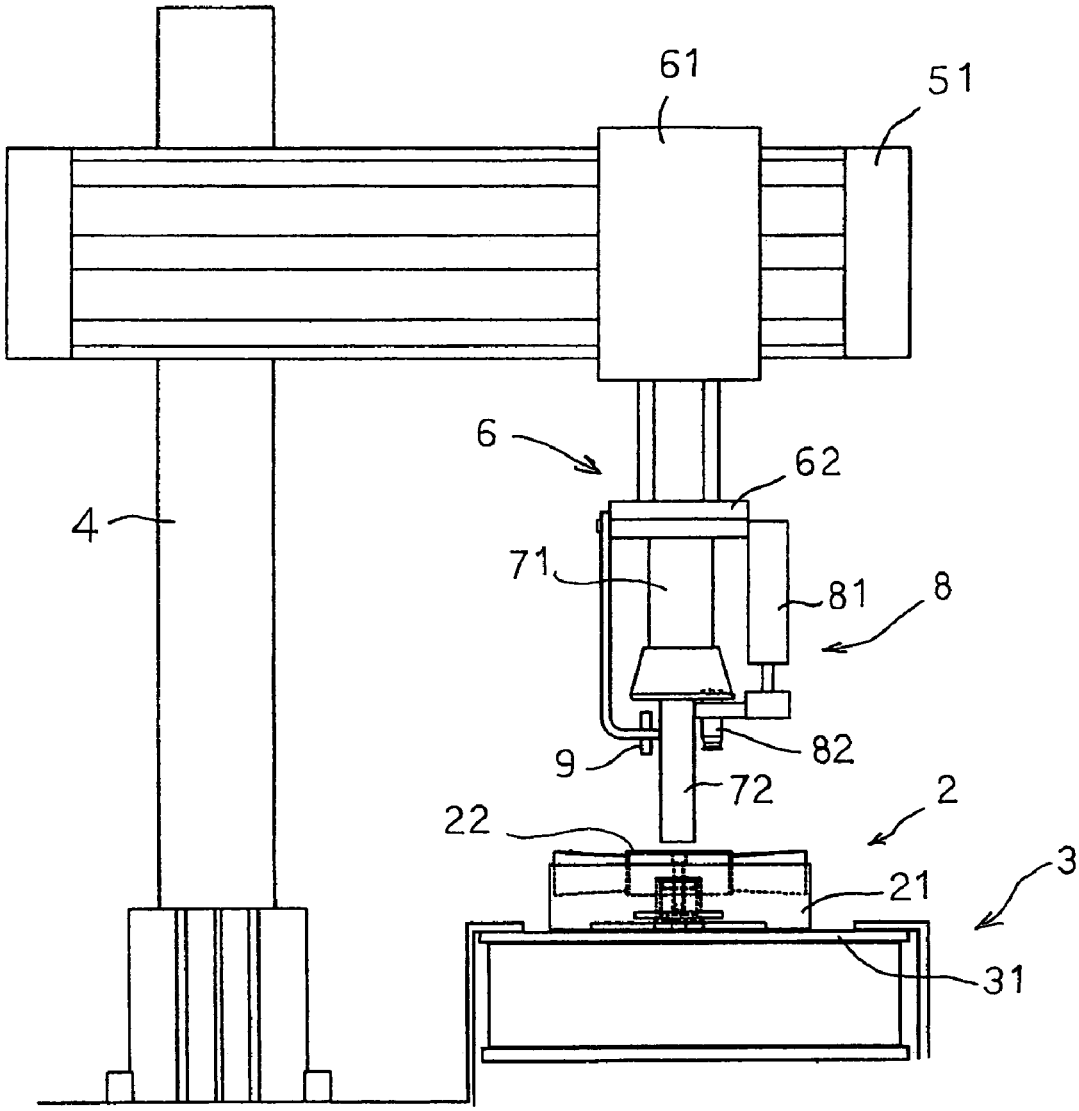
FIG. 3 is a side elevation view of FIG. 2.

Referring to FIGS. 2 and 3, the preferred embodiment of a test device for a heat dissipating fan according to the present invention is suitable for testing quality of assembling the heat dissipating fan 2. The heat dissipating fan 2 includes a housing 21 with a support pipe 211, a fan wheel 22, a retaining ring 23 disposed in the support pipe 211. The fan wheel 22 has a hub 221 and a shaft 222 joined to the hub 221. The shaft 222 forms an engaging groove 223 at an end thereof.

When the heat dissipating fan 2 is set up, a work table 3 with a conveying belt 31 is used for the parts being assembled station by station. First of all, the retaining ring 23 is placed in the support pipe 211 and, then, the fan wheel 22 is placed on the housing 21 to insert the shaft 222 into the support pipe 211. Next, the fan wheel 22 is subjected to a pressure to allow the shaft 222 passing through the retaining ring 23 for the retaining ring 23 engaging with the engaging groove 223. Finally, the heat dissipating fan 2 is delivered with the conveying belt 31 to a position below the test device to be tested if the housing 21 is assembled to the fan wheel 22 firmly.

The test device of the present invention includes a vertical support post 4, a transverse slide unit 5, a vertical slide unit 6, a clamping unit 7, a suction unit 8 and a sensing element 9. The support post 4 is mounted to the work table 3 close to the conveying belt 31.

The transverse slide unit 5 is provided at the top of the support post 4 and disposed above the conveying belt 31. The transverse slide unit 5 has a transverse actuating piece 51 and a transverse slide seat 52, which is driven by the transverse actuating piece 51 to move transversely. The transverse actuating piece 51 in the present embodiment is performed by means of an air accumulation source (not shown) inputting the air to create air pressure for controlling movement of the transverse slide seat 52. Alternatively, hydraulics or a motor controlling a linear guide rail can be used to achieve the purpose of transverse movement as well. It is noted that the preceding implementation for the transverse actuating piece 51 is not to limit the scope of the appended claims.

The vertical slide unit 6 has a vertical actuating piece 61 provided at the transverse slide seat 52 and a vertical slide seat 62, which is driven by the vertical actuating piece 61. The vertical actuating piece 61 is performed by means of pneumatics to control vertical movement of the vertical slide seat 62. Alternatively, hydraulics or a motor controlling a linear slide rail can be used to achieve the vertical movement. It is noted that the preceding implementation for the vertical actuating piece 51 is not to limit the scope of the appended claims.

The clamping unit 7 is attached to the vertical slide seat 62 so as to move with the vertical slide seat 62 upward or downward. The clamping unit 7 has a clamp actuating piece 71 mounted to the vertical slide seat 62 and two holding plates 72, which are actuated by the clamp actuating piece 71 and moved oppositely to each other. Once the clamping actuating piece 71 is driven, the two clamping plates 72 are capable of moving oppositely to hold the housing 21 of the heat dissipating fan 2. The clamp actuating piece 71 operates the two holding plates 72 by means of pneumatics in the present embodiment. Alternatively, hydraulics or a motor controlling gears can be applied instead of pneumatics to allow the two holding plates 72 performing the holding function. It is noted that the preceding implementation for the vertical actuating piece 51 is not to limit the scope of the appended claims.

The suction unit 8 moves along with the vertical slider seat 62 and provides an actuating piece 81 and a suction mouth 81, which is actuated by the actuating piece 81. The suction mouth 82 is used for absorbing the fan wheel 22 of the heat dissipating fan 2. The actuating piece 81 is mounted to the vertical slide seat 62 and the clamping unit 7 moves with the vertical slide seat 62 too such that the actuating piece 81 can be joined to the clamp actuating piece 71. The actuating piece 81 is driven by pneumatics to actuate the suction mouth 82 moving upward and downward. Alternatively, hydraulics or a motor controlling a linear slide rail can be used instead of the pneumatics. The suction mouth creates a absorbing force by means of an air suction equipment (not shown) or an air flow device such as a vacuum generator to provide a negative pressure (vacuum) for absorbing the fan wheel 22.

The sensing element 9 is mounted to the vertical slide seat 62 near the suction mouth 82 for sensing if the suction mouth 82 is able to absorb the fan wheel 22.

Figure 4:
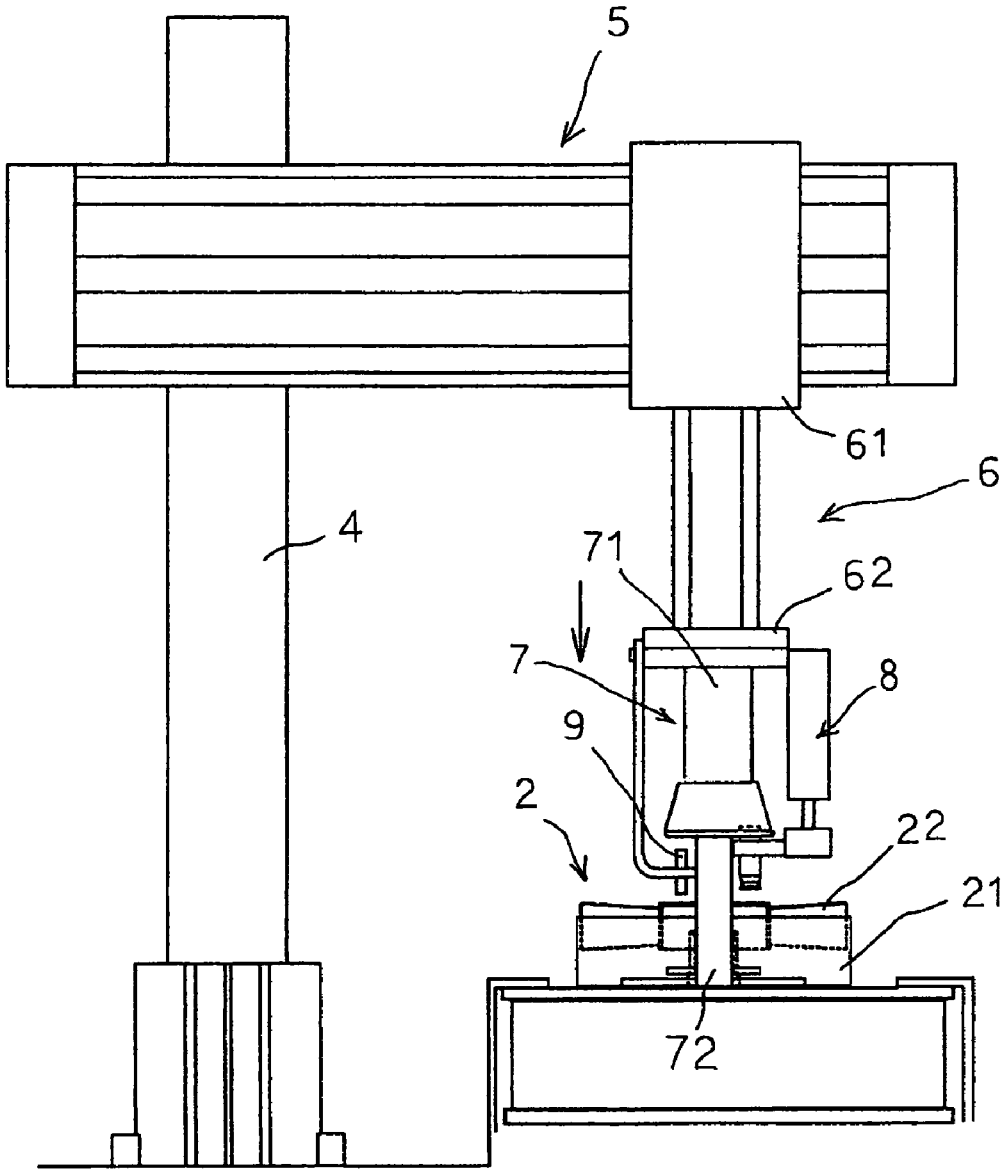
FIG. 4 is a side elevation view similar to FIG. 3 illustrating the vertical slide base of a vertical slide unit moving downward.

Referring to FIG. 4, when the heat dissipating fan 2 is delivered to a position under the test device, the vertical slide actuating piece 61 of the vertical slide unit 6 is operated to actuate the vertical slide seat 62 moving downward to approach the heat dissipating fan 2.

Next, the clamp actuating piece 71 of the clamping unit 7 is controlled to allow the two holding plates 72 moving oppositely to each other (not shown) for holding the housing 21 of the heat dissipating fan 2.

Figure 5:
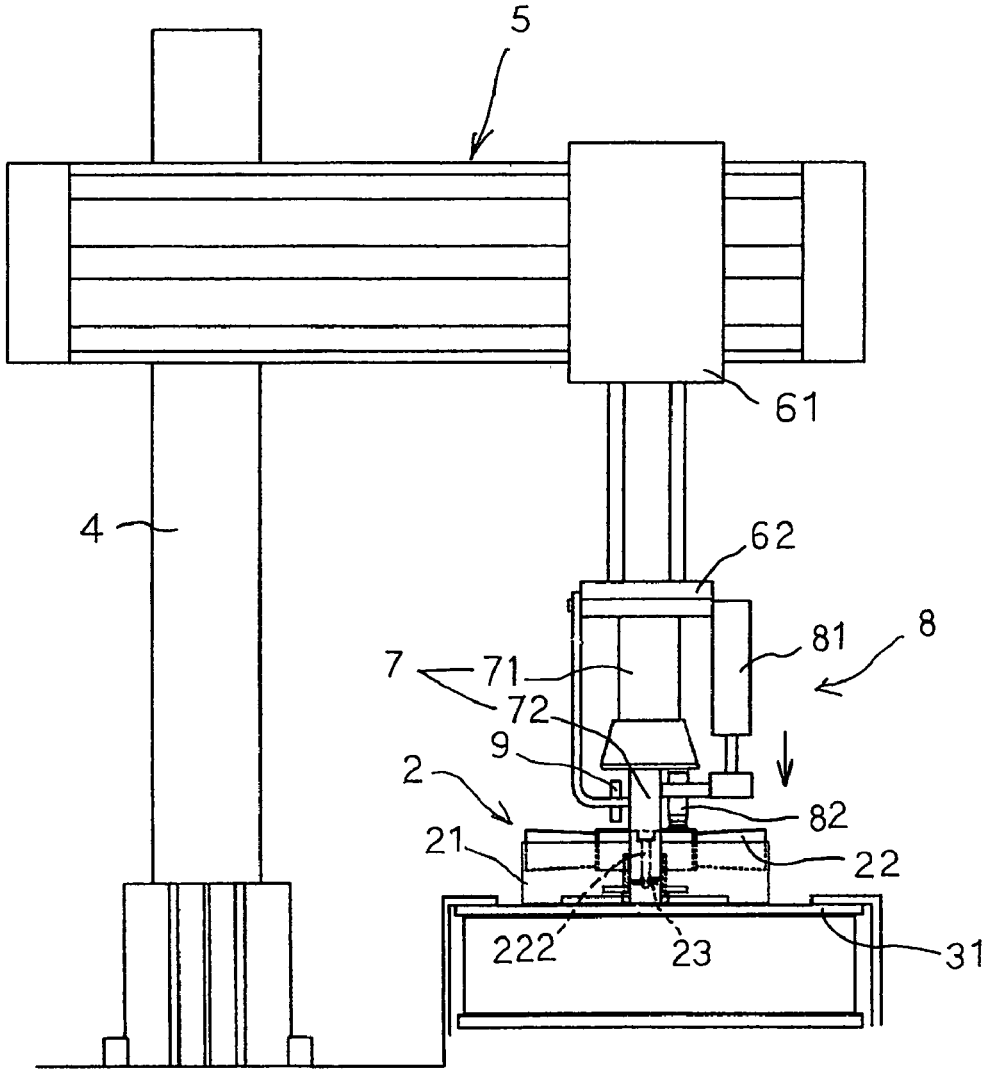
FIG. 5 is a side elevation view similar to FIG. 4 illustrating the suction mouth of a suction unit absorbing the fan wheel.

Referring to FIG. 5, the actuating piece 81 of the suction unit 8, then, is operated to actuate the suction mouth 82 contacting the fan wheel 22 forcedly for sucking the fan wheel 22.

Then, the actuating piece 81 is controlled to move the suction mouth 82 upward and it means the shaft 222 of the fan wheel 22 engaging with the retaining ring 23 firmly in case of the fan wheel being moved a preset distance upward with the suction mouth 82. Under this circumference, the sensing element 9 sends out a signal to the clamp actuating piece 71 and the suction mouth 82 to allow the two holding plates 72 moving oppositely for stopping to clamp the housing 21 and for the suction mouth 82 stopping to suck the fan wheel 22. Hence, the tested heat dissipating fan 2 is determined to pass the test and is placed back on the conveying belt for being operated at the next station.

Figure 6:
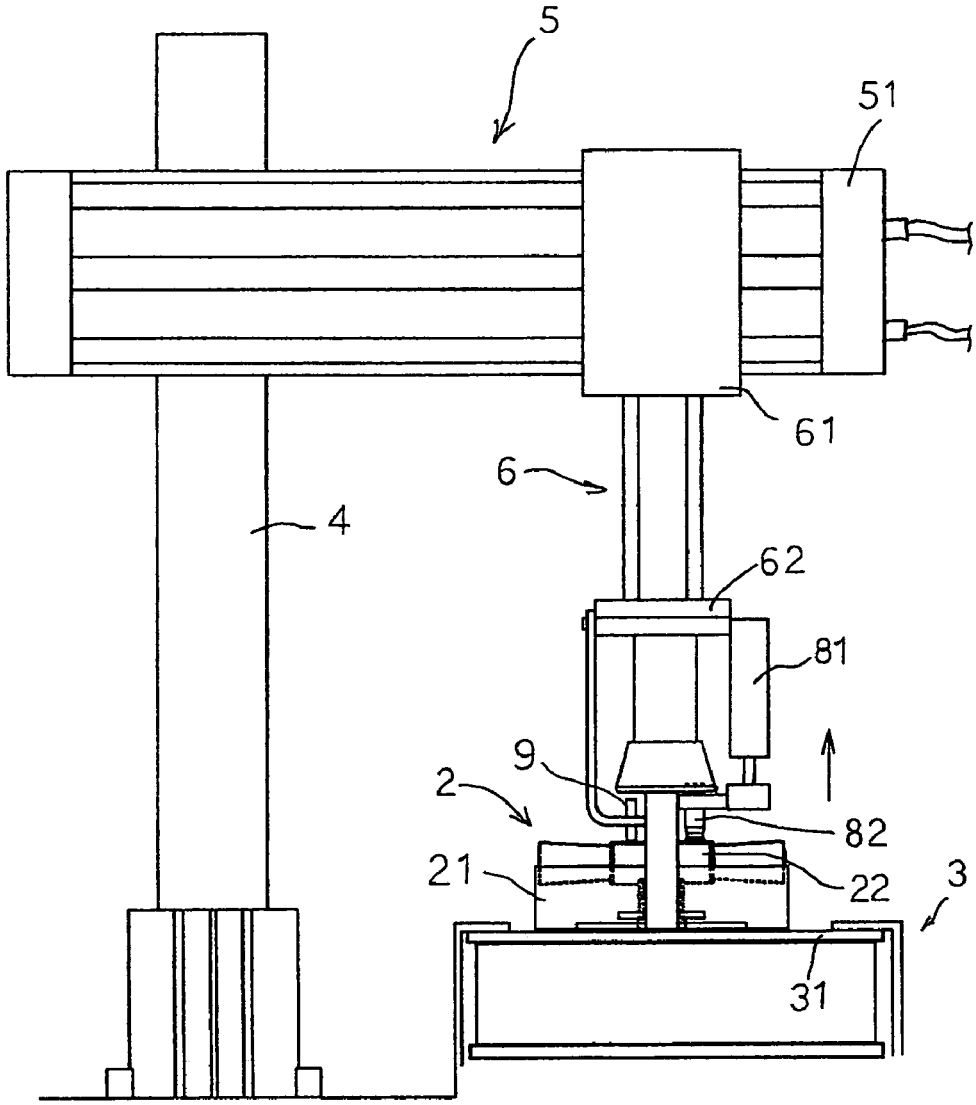
FIG. 6 is a side elevation view similar to FIG. 4 illustrating the suction mouth moving upward with the suction unit and the fan wheel being kept attached to the suction mouth to show the fan wheel being not joined to the housing firmly.
Figure 7:
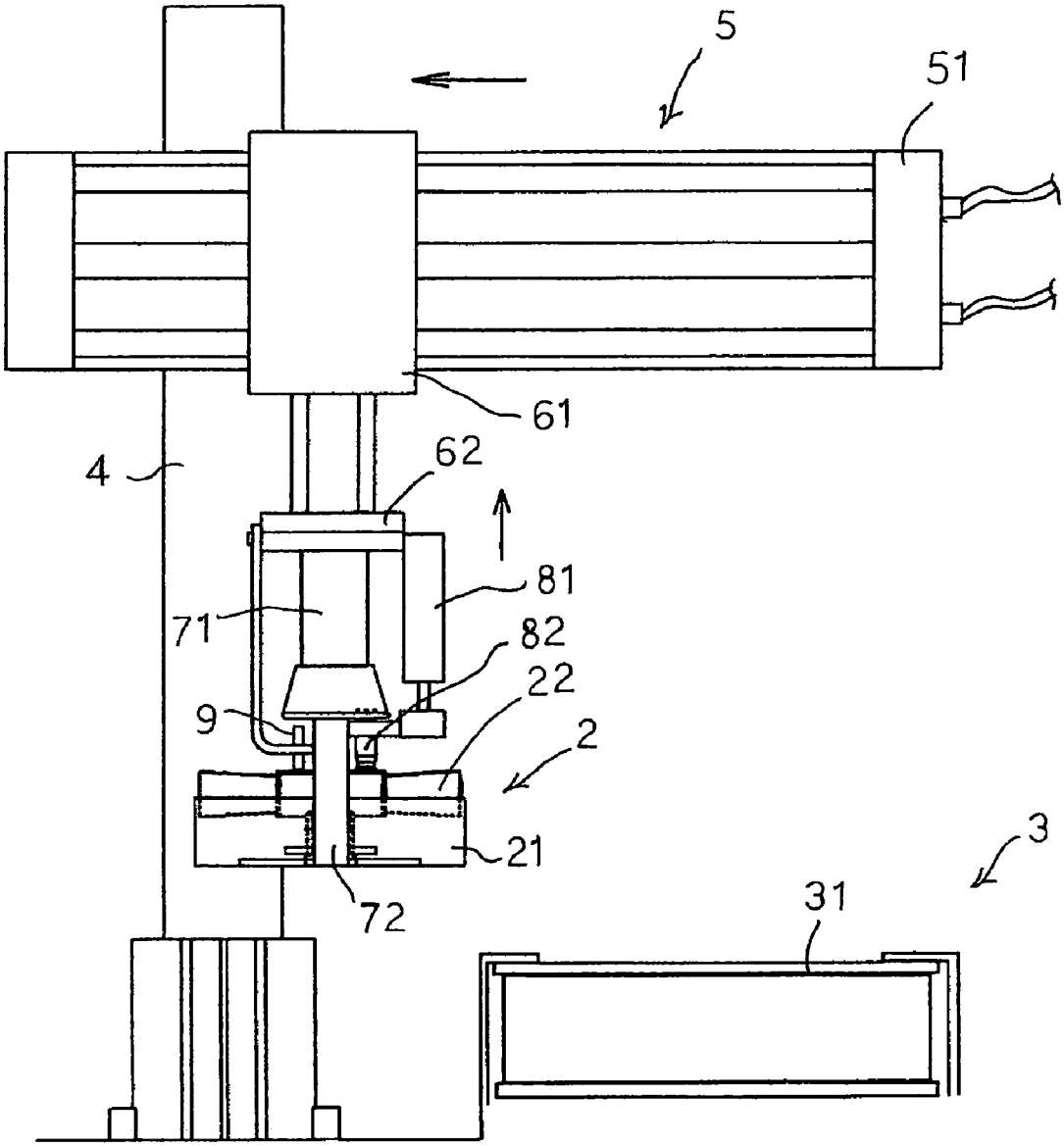
FIG. 7 is a side elevation view of the test device similar to the FIG. 6 illustrating a transverse slide unit holding and moving away the improperly assembled heat dissipation fan.

Referring to FIGS. 6 and 7, the sensing element 9 senses another signal to eliminate absorbing force of the suction mouth 82 under a condition of clamping the housing 21 of the heat dissipating fan 2 in case of the fan wheel 22 moving upward with suction mouth 82 exceeding the preset distance. Meanwhile, the transverse slide actuating piece 51 of the transverse slide unit 5 actuates the transverse slide seat 52 (shown in FIG. 2) to move transversely in combination with the vertical actuating piece 61 of the vertical slide unit 6 such that the heat dissipating fan 2 can be carried away from the conveying belt 31 or delivered to the previous station for being re-assembled. Hence, the assembly quality of the heat dissipating fan can be tested based on this way. Alternatively, magnitude of upward moving force, change of vacuum value or duration of absorbing time can be used for determining if the fan wheel 22 is joined to the housing 21 firmly instead of if the preset distance is exceeded.

It is appreciated that the test device for a heat dissipating fan according to the present invention is capable of holding the housing 21 of the heat dissipating fan 2 by means of the two holding plates 72 of the clamping unit 7, capable of absorbing the fan wheel 22 by means of suction mouth 82 of the suction unit 8 and capable of picking out the heat dissipating fan 2, in which the fan wheel 22 thereof can be sucked to move upward in order to maintain good assembling quality. That is, the testing job for the heat dissipating fan 2 can be performed with a machine instead of manual work for reducing production cost. The upward moving force provided by the suction unit 8 is capable of reaching a consistent operation of testing and determining if the fan wheel 22 is assembled to the housing 21 firmly such that mistakes resulting from personal carelessness can be avoided and assembly quality can be promoted effectively. In addition, the test device can be joined to the production line under automatic operation and it is extremely helpful for enhancing production efficiency.

While the invention has been described with referencing to preferred embodiments thereof, it is to be understood that modifications or variations may be easily made without departing from the spirit of this invention, which is defined by the appended claims.

What is claimed is:

1. A test device for a heat dissipating fan, which is suitable for testing if a fan wheel is assembled to a housing of the heat dissipating fan firmly, comprising:

a vertical support post;

a transverse slide unit, being disposed at the top of the support post, providing a transverse slide actuating piece and a transverse slide seat, which is actuated by the transverse slide actuating piece;

a vertical slide unit, providing a vertical slide actuating piece at the transverse slide seat and a vertical slide seat, which is actuated by the vertical slide actuating piece;

a clamping unit, moving with the vertical slide seat for clamping the housing;

a suction unit, moving with the vertical slide seat for absorbing the fan wheel; and a sensing element, moving with the vertical slide seat and being disposed near the suction unit for sensing if the suction unit is able to absorb and move the fan wheel upward;

wherein, the vertical slide seat moves downward to approach the heat dissipating fan while the vertical slide actuating piece is driven; then, the clamping unit clamps the housing and the suction unit absorbs the fan wheel; the sensing element sends out a signal to the clamping unit and the suction unit to terminate operations of clamp and suction in case of the suction unit being incapable of sucking the fan wheel to move upward; and the transverse slide actuating piece is driven to carry the heat dissipating fan away in case of the fan wheel is sucked to move upward.

2. The test device for a heat dissipating fan as defined in claim 1, wherein the clamping unit provides a clamp actuating piece, which is disposed at the vertical slide seat, and two holding plates, which are actuated by the clamp actuating piece to move oppositely to each other for holding the housing.

3. The test device for a heat dissipating fan as defined in claim 1, wherein the transverse slide actuating piece actuates the transverse slide seat by means of pneumatics.

4. The test device for a heat dissipating fan as defined in claim 1, wherein the vertical slide piece actuates the vertical slide seat by means of pneumatics.

5. The test device for a heat dissipating fan as defined in claim 2, wherein the clamp actuating piece actuates the two holding plates to move oppositely by means of pneumatics.

6. The test device for a heat dissipating fan as defined in claim 1, wherein the suction unit provides a suction actuating piece, which is disposed at vertical slide seat, and a suction mouth, which is actuated by the suction actuating piece for absorbing the fan wheel.

7. The test device for a heat dissipating fan as defined in claim 6, wherein the suction mouth provides a suction force with a negative pressure to absorb the fan wheel.

8. The test device for a heat dissipating fan as defined in claim 6, wherein the suction actuating piece actuates the suction mouth to move vertically by means of pneumatics.

* * * * *